US005603430A

United States Patent [19]

Loehrke et al.

[11] Patent Number: 5,603,430

[45] Date of Patent: Feb. 18, 1997

[54] BEVERAGE DISPENSING SYSTEM WITH BOTTLE IDENTIFICATION MECHANISM

[75] Inventors: John M. Loehrke, Windsor; Thomas L. Heidebrecht, Cambridge, both of Wis.

[73] Assignee: DEC International, Inc., Madison, Wis.

[21] Appl. No.: 386,900

[22] Filed: Feb. 10, 1995

[51] Int. Cl.[6] ..... B67D 5/24

[52] U.S. Cl. ..... 222/1; 222/30; 222/37; 222/641

[58] Field of Search ..... 222/1, 30, 36, 222/37, 640, 641, 77

[56] References Cited

U.S. PATENT DOCUMENTS

| | | | |
|---|---|---|---|
| 3,170,597 | 2/1965 | Reichenberger | 222/36 |
| 3,257,034 | 6/1966 | Dumm, III | 222/36 |
| 3,688,947 | 9/1972 | Reichenberger | 222/27 |
| 3,802,606 | 4/1974 | Gust | 222/181 |
| 3,920,149 | 11/1975 | Fortino et al. | 222/1 |
| 3,993,218 | 11/1976 | Reichenberger | 222/30 |
| 4,034,757 | 7/1977 | Glover | 222/36 X |
| 4,196,418 | 4/1980 | Kip et al. | 340/152 T |
| 4,265,370 | 5/1981 | Reilly | 222/25 |
| 4,278,186 | 7/1981 | Williamson | 222/36 |
| 4,436,223 | 3/1984 | Wilson | 222/36 |
| 4,598,845 | 7/1986 | Ozdemir | 222/449 |
| 4,654,658 | 3/1987 | Walton | 340/825.54 |
| 4,656,472 | 4/1987 | Walton | 340/825.34 |
| 4,660,742 | 4/1987 | Ozdemir | 222/36 |
| 4,736,871 | 4/1988 | Luciani et al. | 222/25 |
| 5,007,560 | 4/1991 | Sassak | 222/1 |
| 5,255,819 | 10/1993 | Peckels | 222/1 |
| 5,295,611 | 3/1994 | Simard | 222/129.3 |
| 5,318,197 | 6/1994 | Martindale et al. | 222/1 |
| 5,379,916 | 1/1995 | Martindale et al. | 222/1 |

FOREIGN PATENT DOCUMENTS 0517172 12/1992 European Pat. Off. .

OTHER PUBLICATIONS

*Versatile Semiconductor Products Phase encoded Transponder* VSP1000 Jan. 1, 1991.

*Primary Examiner*—Andres Kashnikow
*Assistant Examiner*—Kenneth Bomberg
*Attorney, Agent, or Firm*—Quarles & Brady

[57] ABSTRACT

A separate spout is attached to each open bottle in a tavern with each spout having a magnetically operable valve to control the flow of liquor from the bottle. A transponder is provided in each spout transmits an unique identification code. To pour liquor from a bottle, an actuator is placed over the spout. An interrogator coupled to an interrogator coil in the actuator for sending an activation signal to the transponder and thereafter reads the identification code. A memory provides a group of storage locations for each of the plurality of spouts. The group of storage locations for a given spout contains the identification code for that spout and data regarding a total volume dispensed from a particular bottle to which the given spout is attached, a quantity present in the particular bottle when full, and a price per volume unit. A controller energizes a valve operating coil in the actuator to open a valve in response to the interrogator reading the identification code from a spout. Upon energizing the valve operating coil, the controller accesses the memory and updates data in the group of storage locations which contain the identification code read from a spout. The system accounts for the amount of liquor dispensed from each bottle and the value of that liquor to monitor the liquor inventory and sales.

19 Claims, 5 Drawing Sheets

BOTTLE DATA

| |
|---|
| SPOUT ID CODE |
| VOLUME POURED |
| UPC NUMBER |

120

FIG. 8

LIQUOR BRAND DATA

| |
|---|
| UPC NUMBER |
| NAME OF LIQOUR BRAND |
| LIQOUR TYPE |
| VOLUME OF BOTTLE |
| VOLUME OF SERVING |
| PRICE PER SERVING |
| POUR TIME |
| NUMBER OF POURS |
| VOLUME OF BRAND POURED |
| SALES VALUE |
| COMPLIMENTARY POURS |
| COMPLIMENTARY VOLUME |
| COMPLIMENTARY SALES |
| CANCELED POURS |
| CANCELED VOLUME |
| CANCELED SALES |

122

FIG. 9

COCKTAIL DATA

| |
|---|
| KEYBOARD BUTTON ID |
| COCKTAIL NAME |
| FIRST INGREDIENT |
| FIRST VOLUME |
| SECOND INGREDIENT |
| SECOND VOLUME |
| THIRD INGREDIENT |
| THIRD VOLUME |
| FOURTH INGREDIENT |
| FOURTH VOLUME |
| FIFTH INGREDIENT |
| FIFTH VOLUME |
| PRICE PER COCKTAIL |
| NO. COCKTAILS SERVED |
| SALES VALUE |
| COMPLIMENTARY POURS |
| COMPLIMENTARY SALES |
| CANCELED POURS |
| CANCELED SALES |

124

FIG. 10

BEVERAGE DISPENSING SYSTEM WITH BOTTLE IDENTIFICATION MECHANISM

BACKGROUND OF THE INVENTION

The present invention relates to systems for dispensing beverages from bottles, and more particularly to systems for dispensing measured amounts of liquid from a bottle and accounting for the quantity and cost of the liquid so dispensed.

A bartender commonly pours liquor from a bottle into a glass in which a drink is being mixed. A spout is often attached to the mouth of the bottle to dispense the liquor at a relatively constant flow rate so that a bartender can "free pour" the liquor without the need for a measuring device, such as a jigger. Even at a constant flow rate, the exact amount of liquor poured into each drink varies depending upon the bartender, and varies from drink to drink poured by the same bartender. Such variation affects the profits derived from a given bottle of liquor. In addition, simple bottle spouts do not provide any mechanism to ensure that each drink dispensed from a bottle was rung up on the cash register. Thus, a bartender has been able to serve free or generous drinks to friends and preferred customers without accounting to the tavern management.

In response to these problems, more sophisticated liquor dispensing equipment has been devised. One such system is described in U.S. Pat. No. 3,920,149 and provides each bottle with a spout that has a magnetically operated valve. When liquor was to be poured from a given bottle, its spout was placed inside an actuator ring that is connected to a computer via a cable. When the bottle and the ring were inverted, a switch closed causing an electromagnetic coil in the ring to be energized which opened the valve in the spout. The valve was held open for a defined period of time which dispensed a given volume of liquor because of a relatively constant flow rate through the spout. When that time period ends, the electromagnetic coil was deenergized by the computer and the valve closed.

Three rings were provided on the outside of the spout and by selecting either metal or plastic for each ring and the price of a drink could be encoded which was read electromagnetically by the actuator ring. However, the size of the spout accommodated only three rings which did not provide enough codes to uniquely identify each spout in the bar. As a consequence, the specific spout (or liquor bottle) could not be identified; rather, only an identification of the price class for the liquor. Thus, this previous system could not determine how many drinks were dispensed from each bottle and keep track of the liquor inventory at the bar.

SUMMARY OF THE INVENTION

A general object of the present invention is to provide a mechanism for automatically dispensing a predefined quantity of beverage from a container.

Another object of the present invention is to provide a mechanism for uniquely identifying the bottle from which the beverage is being poured to account for the total quantity of beverage dispensed from that specific bottle. This also enables the inventory of the bar to be determined automatically at any instant in time.

A further object of the present invention is to provide a mechanism for calculating the total dollar value of beverage which has been dispensed from a bottle, and from all the bottles in a given bar during a specific period of time.

These objects are satisfied by a liquid dispensing system in which a separate spout is placed on each bottle. The spout has a flow passage controlled by a magnetically operable valve and a transponder which transmits an identification code that is unique to that particular spout. The valve is operated by an actuator that is placed near to the spout in order the dispense liquid. The actuator includes a valve operating coil that when energized produces a magnetic field which opens the valve. An interrogator is provided for activating the spout transponder and reading the identification code.

A memory provides a group of storage locations associated with the identification code. Depending upon the sophistication desired for inventory and sales monitoring, the storage locations contain a variety of data related to the dispensing of liquid from the bottle to which the spout is attached. For example such information can include the quantity of liquid dispensed from a bottle and a number of volume units of liquid present in that bottle when full, and the price of the liquid per volume unit. Other information can include the interval of time to hold the valve open to dispense a serving of liquid, the volume in a serving and the total sales of that kind of liquid. By storing the name of the liquid, the name can be displayed to the user while dispensing is occurring.

A controller is connected to the interrogator to receive the identification code read from the spout and is connected to the actuator to control production of the magnetic field to open the valve for a predefined period of time, said controller coupled to said memory and updating the data regarding a volume dispensed from the liquid container in response to the valve being opened, the controller including a mechanism for calculating a quantity of liquid remaining in the liquid container.

BRIEF DESCRIPTION OF THE DRAWINGS

FIG. 8 depicts the data structure of a table in the memory of the computer that stores information about the bottle connected to a given spout;

FIG. 9 represents the data structure of a table in the computer memory that contains information about the liquor in one of the bottles;

FIG. 10 depicts a table in the computer memory that stores information for mixing a cocktail.

DETAILED DESCRIPTION OF THE INVENTION

Figure 1:
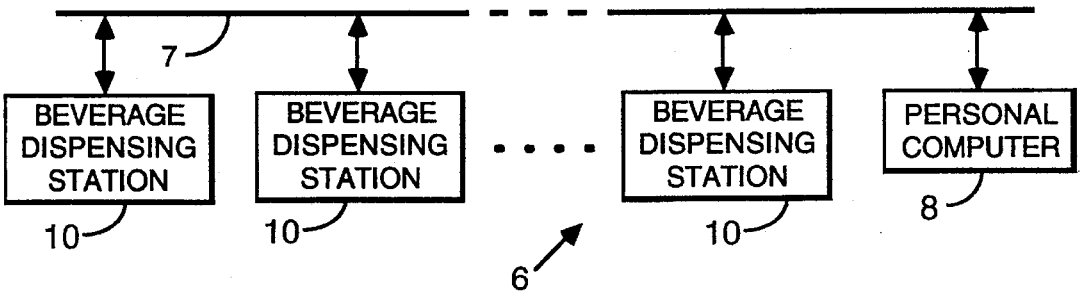
FIG. 1 schematically illustrates a beverage dispensing system according to the present invention.

With initial reference to FIG. 1, a facility such as a large tavern or hotel may have several bars at which alcoholic beverages are served. A beverage dispensing system 6 monitors the serving of beverages to provide liquor inventory accounting and productivity reports for each bar and the entire facility. The system 6 includes a separate beverage dispensing station 10 at each bar and a large bar may have several beverage dispensing stations, one for each bartender for example. The beverage dispensing stations 10 are connected via a local area network 7 which provides two-way communication with a personal computer 8 that typically is located in the office of the beverage manager for the facility. Each beverage dispensing station 10 tabulates the liquor sales at that bar location and periodically transmits the tabulated data to the personal computer. The personal computer 8 uses the transferred data to produce reports on liquor inventory and the productivity of each dispensing station 10 and the tavern or hotel as a whole. Although the beverage dispensing stations 10 are specifically designed for a facility where several of them are networked together, a single beverage dispensing station 10 can be used in a stand-alone manner in a small neighborhood bar to provide the same type of inventory monitoring.

Figure 2:
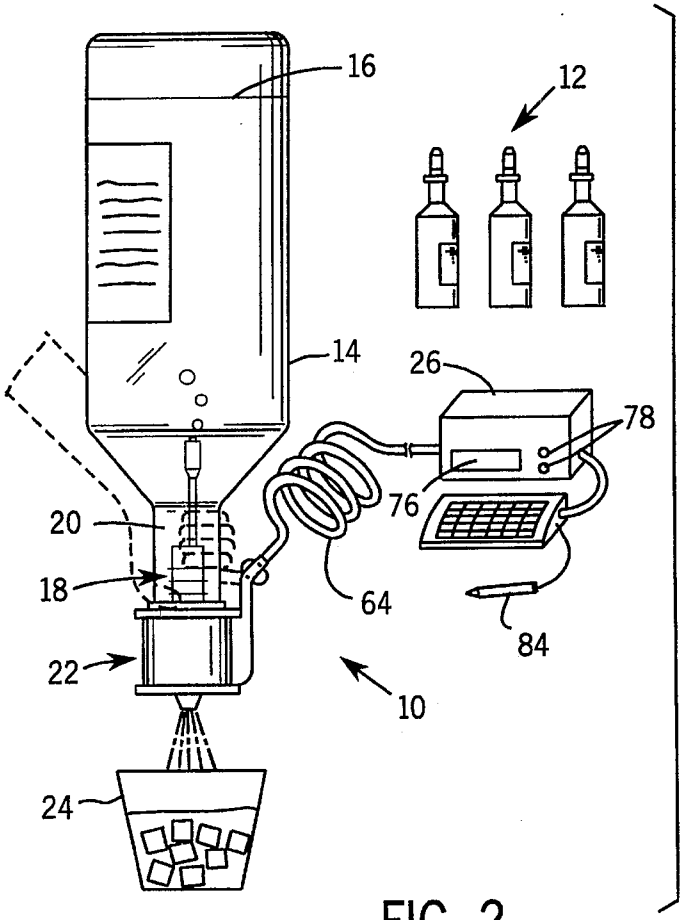
FIG. 2 is a pictorial illustration of a beverage dispensing stan shown in FIG. 1.

Referring to FIG. 2, in order to monitor beverage dispensing, each station 10 operates in connection with a number of different spouts placed on liquid containers, such as liquor bottles 12 kept at a bar. Liquor 16 is shown being poured from a particular bottle 14 into a glass 24, such as the type for serving mixed alcoholic drinks in a tavern or the like. A spout 18 is inserted into the open neck 20 of bottle 14 and projects outwardly therefrom.

The spout 18 has an internal valve that is operated by a spout actuator 22 into which the spout is placed in order to dispense liquor from the bottle. When the spout is coupled to actuator 22 and inverted by the bartender, the station 10 senses the inversion and interrogates a transponder within the spout 18. In response, the transponder transmits a unique code identifying that particular spout 18 and thus the liquor bottle attached to the spout. Upon receiving the identification code, a controller 26 energizes the actuator 22 to open a valve within the spout 18 causing liquor to flow into glass 24 for a predetermined interval of time.

Dispensing station 10 finds special application as a means for serving liquor from a number of bottles 12 at a bar and for accounting not only for the volume of liquor dispensed from the bottles, but also the total dollar amount of the liquor dispensed. Because the flow rate of liquor through the spout 18 is relatively constant, the controller 26 is able to calculate the volume of liquor that is dispensed while the spout valve is open. This dispensed volume is used to update the stored records of the total amount of liquor dispensed from that particular bottle 14. In addition, the controller has been programmed with the cost of a volume unit of the liquor for that bottle and is able to determine the dollar volume of the beverage which has been dispensed therefrom. The controller 26 also can be programmed with the total volume of a full beverage bottle when a new spout is attached. This enables the controller to derive how much liquor remains in the bottle by subtracting the dispensed volume from the full bottle volume. Records of these parameters can be kept on a work shift basis to determine the amount of liquor dispensed and the total dollar amount taken in during each work shift. The recorded sales information can be reconciled with the money that is present in the tavern cash registers at the end of the work shift.

Figure 3:
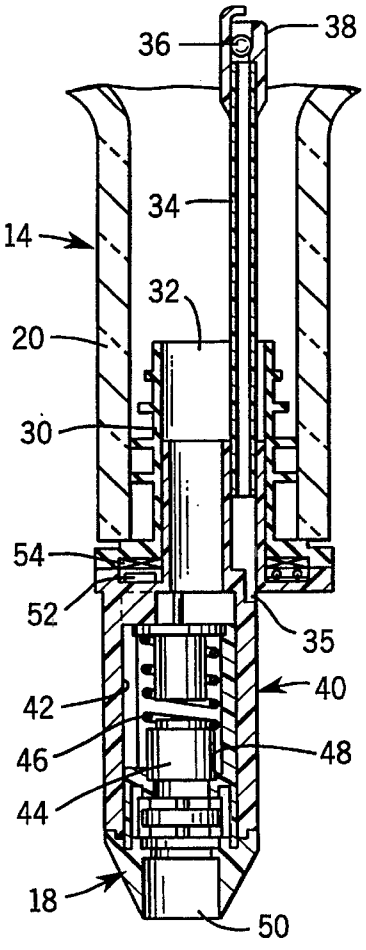
FIG. 3 is an enlarged, cross sectional view of a spout used in the beverage dispensing system.

The spout 18 is shown in greater detail in FIG. 3 and includes a plastic liner 30 making a watertight seal between the spout 18 and the inner surface of the neck 20 of bottle 14. The liner 30 can have other constructions, if desired, such as a conventional cork. The spout 18 has a tamper-indicator, such as a stamp seal (not shown), to detect unauthorized attempts to remove the spout from the bottle. As a consequence, the only way to pour liquid from the bottle is to use the actuator 22. The liner 30 has a tubular configuration with an inner passage 32 through which the liquor in the bottle 14 enters the spout. The liner 30 also contains a breather tube 34 that allows air to pass into the bottle 14 to replace the liquor which flows outward through passage 32. A ball 36 held within a cage 38 at the inward end of the breather tube 34 prevents liquid from escaping through the breather tube. The air enters a breather hole 35 and flows through the breather tube 34 into the bottle.

The spout 18 has an external section 40 with an internal chamber 42 which is in fluid communication with passage 32. A movable valve member 44 is located within the chamber 32 and is biased by a spring 46 against a valve seat 48 in the normal position of the valve mechanism within the spout. Thus, the spout is normally closed preventing liquor 16 from flowing out of the bottle 14 through an outlet opening 50 in the end of the spout. Because the valve member 44 is made of ferromagnetic material, the application of an external magnetic field causes the valve member 44 to move against the force of spring 46 and away from seat 48 allowing beverage to flow from the bottle.

The external section 40 of spout 18 also contains a transponder circuit 52 coupled to an annular coil 54 in a cavity around inner passage 32. As will be described in greater detail subsequently, when the coil 54 receives a radio frequency (RF) activation signal, the transponder circuit 52 applies a spout identification code signal to the coil. The device that sent the RF signal can detect the application of the identification code signal to transponder coil 54 and read the identification code from the transponder circuit. The identification code is unique to this particular spout 18, allowing the spout, and hence the particular bottle 14 to which it is attached, to be identified and distinguished from the other bottles 12 at the bar. Each bottle at the bar has a spout with a different identification code.

Figure 4:
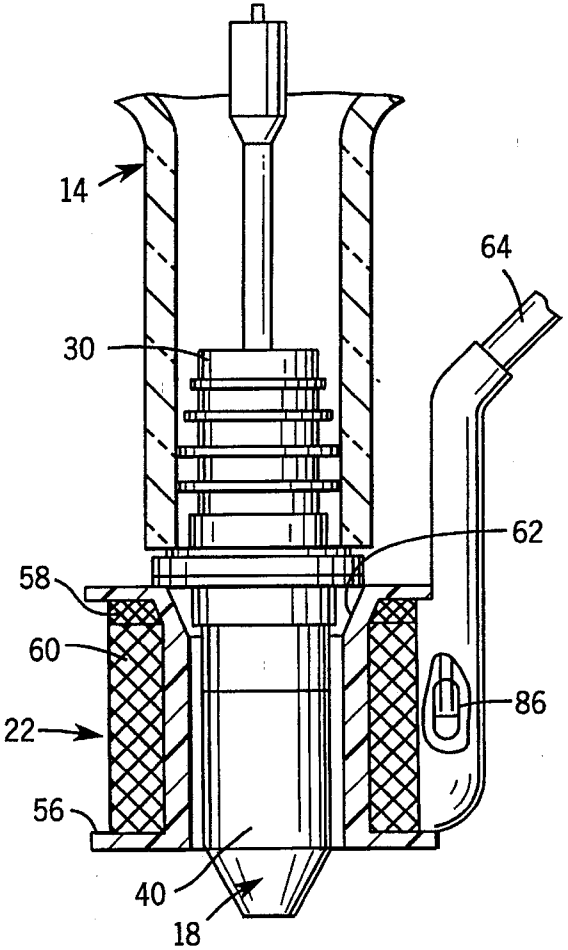
FIG. 4 is a partial cross sectional view of the spout and a spout actuator attached to a beverage bottle.

With reference to FIG. 4, the actuator 22 is placed around the section 40 of the spout 18 that projects from the bottle 14. The actuator has an annular bobbin 56 of a type commonly used to support electromagnetic coils. The bobbin 56 has a tapered opening 62 at one end for receiving spout 18. An interrogator coil 58 is wound on the bobbin 56 near the one end and is adjacent to the transponder coil 54 when the actuator 22 is placed on the spout 18. A larger valve operating coil 60 also is wound around the bobbin 56 to produce an electromagnetic field which moves the spout valve member 44 away from the seat thereby allowing liquor to flow from the bottle 14, when the spout 18 placed into the actuator.

A mercury tilt switch 66 is located within the actuator 22 so that the switch contacts open when the actuator is in the inverted position as illustrated in FIGS. 2 and 4. Wires from the interrogator coil 58, the valve operating coil 60 and tilt switch 66 form a cable 64 connected to controller 26 as shown in FIG. 2.

Figure 5:
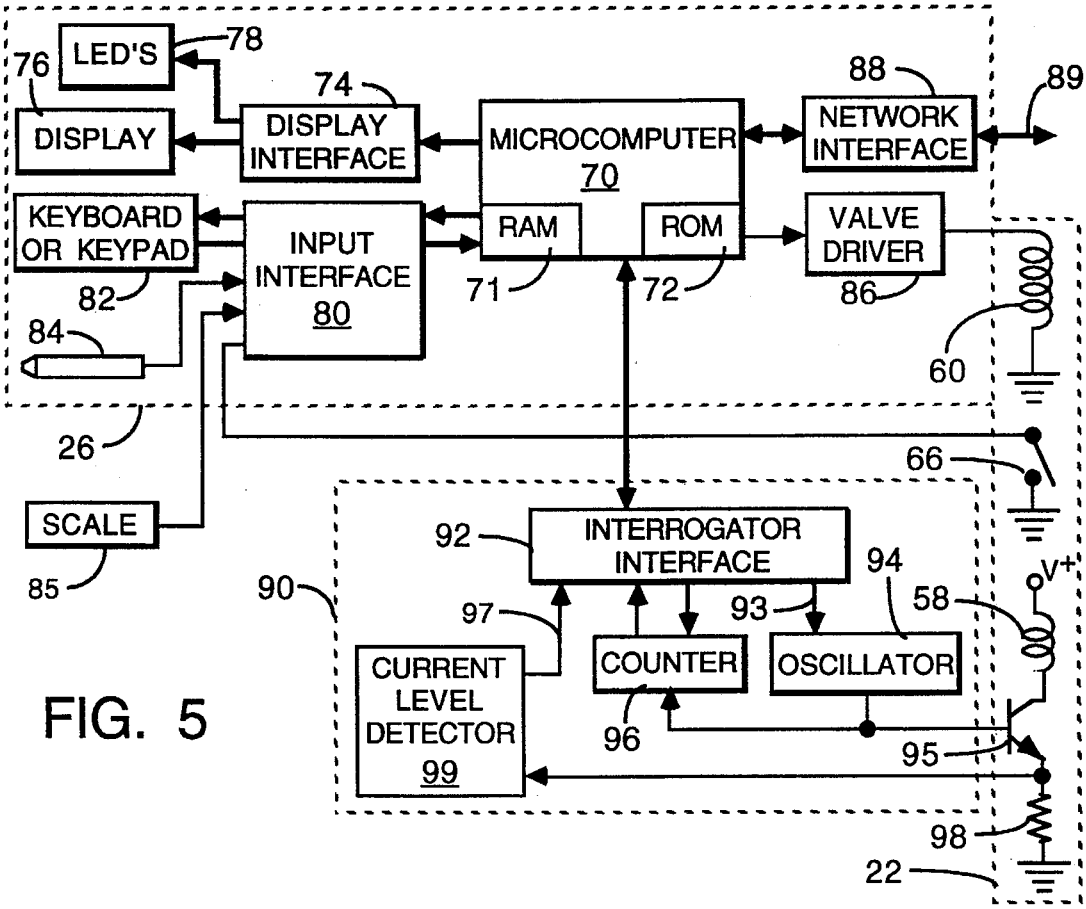
FIG. 5 is a schematic diagram of the actuator and computer of the dispensing station.

Referring to FIG. 5, the controller 26 is built around a microcomputer 70 that contains a microprocessor, input/output circuits, a battery backed-up random access memory (RAM) 71 and a read only memory (ROM) 72 which stores the control program for operating the dispensing station 10. External memory can be connected to the microcomputer 70 to provide additional storage capacity. The microcomputer 70 is connected to a display interface 74 which operates a two line by twenty character liquid crystal display 76 on the front panel of the controller. As will be described, display 76 is utilized to inform the bartender of the type of liquor being dispensed from bottle 14 and other information regarding operation of the dispensing station. The display interface 74 also operates a number of light emitting diodes 78 which indicate functional status of the dispensing station 10.

The microcomputer 70 is coupled via a input interface 80 to a standard alphanumeric keyboard 82. In installations of the dispensing station 10 in which a full alphanumeric keyboard is not required, a custom keyboard having push-button switches for specific functions can be provided, as will become apparent from the subsequent description of the system operation. The input interface 80 also acts as an input interface for signals from the actuator tilt switch 66 and a bar code reader 84 that is used to read a Universal Product Code (UPC) on liquor bottles 12 and 14. A scale 85 with a communications port, such as a scale used with a cash register in a grocery store, is connected to the microcomputer 70 via the input interface 80.

The microcomputer 70 has an output line connected to a valve driver 86 which responds signals on the output line by energizing the valve operating coil 60 in the actuator 22 to open the spout valve. A conventional network interface 88 enables microcomputer 70 to communicate via a communication link 89 with other devices, such as personal computer 8 in FIG. 2.

The controller 26 also operates an interrogator circuit 90 which reads the identification code from a spout 18 placed within the actuator 22. Interrogator circuit 90 includes an addressable interrogator interface 92 that is connected to address and data lines extending from microcomputer 70. By addressing the interrogator interface 92, the microcomputer 70 is able to exchange data and control signals with the interrogator circuit 90. When properly accessed, interrogator interface 92 generates an interrogation enable signal on output line 93 which activates an oscillator 94. The oscillator 94 generates a radio frequency signal which controls a driver transistor 95 that switches current to the interrogator coil 58 of the actuator 22.

The output of oscillator 94 also is connected to the input of a digital counter 96 which counts cycles of the oscillator signal. The data output of counter 96 is connected to parallel inputs of the interrogator interface 92 enabling the cycle count to be read by the microcomputer 70.

The interrogator coil 58 and driver transistor 95 are connected in series with a current sensing resistor 98. A current level detector 99 is coupled to the current sensing resistor 98. As will be described, serial transmission of the identification code from a spout transponder 52 changes the inductive loading on the interrogator coil 58. This change in loading causes the current through the interrogator coil 58 to vary above and below a threshold level depending upon whether a binary one or zero is being read from the transponder 52. The current level detector 99 senses whether the interrogator coil current is above or below the threshold and responds by producing a low or high logic level output that corresponds with the binary signal from the transponder 52. The output of the current level detector is applied to an input of interrogator interface 92 so that microcomputer 70 can recover the spout identification code.

Figures 6, 7A, 7B, 7C, 7D, 7E, 7F:
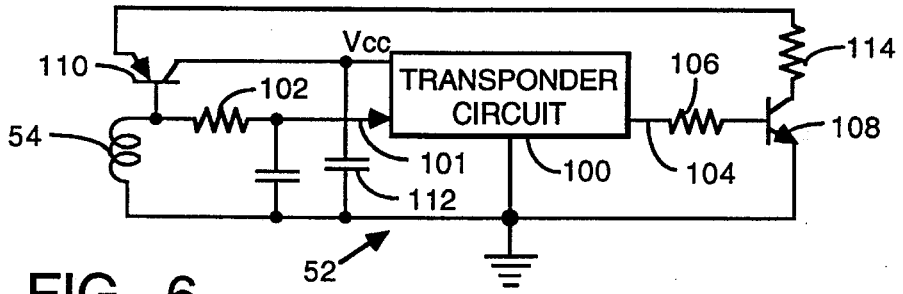
FIG. 6 is a schematic diagram of a transponder in the spout.
FIGS. 7A through 7F are waveforms illustrating signal patterns used to send data between the spout transponder and an interrogator circuit.

FIG. 6 depicts the circuitry of the transponder 52 in the spout 18. The transponder utilizes a commercially available transponder circuit 100, such as integrated circuit model VSP1000 manufactured by the Versatile Semiconductor Products Division of Reining, S.C. of Madison, Wis. An identification code for the associated spout is stored as a binary number in a read only memory within the transponder circuit when the spout is fabricated. A clock input 101 of the transponder circuit 100 is coupled by resistor 102 to a first end of the transponder coil 54, so that cycles of the RF signal received by the coil clock the stored identification code onto an output line 104. The output line is coupled by resistor 106 to the base of an output transistor 108 having an emitter connected to a second end of the transponder coil 54.

The first end of the transponder coil also 54 is connected to the base of transistor 110 having a collector connected to the positive supply voltage input Vcc of the transponder circuit 100. A power filter capacitor 112 is connected between input Vcc and circuit ground. The emitter of transistor 110 is connected by resistor 114 to the collector of the output transistor 108. The alternating voltage induced in the transponder coil 54 is rectified by transistor 110 and applied across the Vcc and ground inputs of the transponder circuit 100 thereby powering the transponder 52.

Before explaining operation of the system 6 in dispensing beverages, an understanding of how the identification code is read from the spout by the interrogator circuit 90 will be helpful. When an actuator 22 is placed on the bottle spout and inverted as shown in FIGS. 2–4, the mercury tilt switch 66 opens sending a signal via the input interface 80 to the microcomputer 70 illustrated in FIG. 5. The microcomputer responds by sending a command to the interrogator interface 92 which enables the oscillator 94 to produce a high frequency interrogation signal. This interrogation signal is applied by driver transistor 95 to the interrogator coil 58 inside the actuator 22.

The high frequency signal is inductively coupled from the interrogator coil 58 to the transponder coil 54 in the spout 18, see FIG. 6. This high frequency signal energizes the transponder 52 causing the transponder circuit 100 to begin reading the stored identification code from its memory. The cycles of the radio frequency signal sent from the actuator 22 are used by the interrogator circuit 100 as a clock signal to read each bit of data from memory. The data bits have a duration of 16 clock cycles shown in FIG. 7A, but have varying duty cycles depending upon the type of data bit. The transponder circuit outputs the identification code as a serial packet which begins with a start bit. As shown in FIG. 7B, the start bit has a high logic level for four clock cycles, a low logic level for the next four clock cycles, then another high logic level for four clock cycles and finally a low logic level for four clock cycles. This unique start bit indicates the beginning of a packet. A sync bit depicted in FIG. 7C follows the start bit and is formed by a high logic level for eight clock cycles with a low logic level for eight clock cycles thereafter. The one and zero data bits of the identification code then are transmitted. A zero bit as shown in FIG. 7D has a high logic level for four clock cycles and then a low logic level for twelve clock cycles. With reference to FIG. 7E, a one bit has a high logic level for twelve clock cycles followed by a low logic level for four clock cycles. The packet terminates with a stop bit comprising a low logic level for sixteen clock cycles as shown in FIG. 7F.

The identification code is transmitted serially from the spout transponder using a reflected load technique in which the high and low logic levels clocked from the transponder circuit 100 vary the load on the transponder coil 54. Specifically, the high and low logic levels of the identification code render output transistor 108 conductive and non-conductive respectively. When the output transistor is conductive, resistor 114 is connected to the transponder coil 54 which alters the loading of the coil. As the loading on the transponder coil changes, the level of current drawn through the interrogator coil 58 changes correspondingly. The interrogator circuit 90 monitors the current level through the interrogator coil 58 to thereby detect the high and low logic levels being read from the transponder circuit 100. By measuring the duration of each high and low logic level, the controller 26 is able to determine the binary identification code for the spout. Specifically, the current level detector 99 senses the voltage across the current sensing resistor 98 to measure the relative magnitude of the current flowing through interrogator coil 58. The current level detector 99 produces a binary output signal on line 97 which has a logic level that depends on whether the measured current is above or below a defined threshold level. This binary output signal corresponds to the logic levels used by the transponder 52 to encode the identification code.

The microcomputer 70 senses each logic level transition of the binary output signal from the current level detector 99. Whenever a transition in the current level is sensed, the microcomputer 70 reads the value of counter 96 to determine the relative length of the previous logic level. The counter 96 output is a count of the oscillator signal cycles which cycles also were used to clock data from the transponder 52. Therefore, by subtracting the present value of the counter from the counter value stored at the previous logic level transition, the duration of the previous logic level in terms of transponder clock cycles can be determined.

Thus, when the microcomputer 70 detects two pairs of high and low logic levels in which each level has a duration of four clock cycles, the microcomputer recognizes that a start bit of a message packet has been received. Similarly, a data bit having a logic level of four clock cycles followed by a low logic level for 12 clock cycles is interpreted by the microcomputer as a zero data bit; whereas a data bit having a high logic level for 12 clock cycles and a low logic level for four clock cycles is interpreted as a one data bit. In this manner, the microcomputer 70 is able to receive the data packet from the transponder 52 and recover the spout identification code.

Although the present invention is being described in the context of a particular transponder circuit and data transmission technique and format, the beverage dispensing system 6 can be implemented using other transponder types and data transmission schemes.

In order for the beverage dispensing system 6 to tabulate the amount of liquor dispensed from each bottle 12 in the tavern or hotel, information about the bottles and the type of liquor therein must first be stored into the RAM 71 of microcomputer 70. In a large installation, a separate beverage dispensing station 10 may be placed in a central liquor storeroom and dedicated to updating the system each time a spout is placed on a new liquor bottle. To input information about the liquor bottle, a bartender or tavern manager places the controller 26 of that beverage dispensing station 10 into the bottle registration mode by entering commands into keyboard 82 or by selection of a menu item presented on display 76. The new liquor bottle is opened, and a spout 18 installed with a seal properly applied. Then the spout is placed into an actuator 22. In the bottle registration mode, the microcomputer 70 enables the interrogator circuit 90 and specifically its oscillator 94 even though the tilt switch 66 does not indicate that the bottle has been inverted. Thus, the interrogator circuit 90 energizes the transponder 52 in the spout that has been placed on the new bottle and the controller 26 reads the identification code from that spout. That code is used to access a section of the RAM 71 that stores tables of information relating to each possible identification code and thus each spout.

A table 120 of data for one spout and the storage locations of that table are depicted in FIG. 8. The first storage location holds the spout identification code. Another storage location stores the quantity of liquor that has been poured from this bottle and initially is set to zero. The controller 26 keeps track of the amount of beverage poured from a bottle in terms of ounces or milliliters depending upon the units of measurement selected by the user. The number contained in the "volume poured" storage location for the bottle is a numeric count of those volume units.

The controller 26 then prompts the user via display 76 to use the bar code scanner 84 to read the UPC number on the liquor bottle to which the spout has been attached. This UPC number is stored as another item of data in table 120 for the particular spout. When the UPC number is read, the microcomputer 70 scans another set of tables containing liquor brand data in RAM 71, to determine whether information about the liquor corresponding to this UPC number has been previously entered into the controller. If a UPC number match is found, the name of the liquor is presented to the user via display 76. If the UPC number is not found in the liquor brand data table, i.e. that brand or bottle size has never been used previously, information about the brand has to be entered by the user. If the system 10 is being used in a country that does not have UPC codes on liquor bottles, a unique code can be arbitrarily defined for each liquor brand and bottle size.

FIG. 9 depicts a table 122 associated with a given brand of liquor. The first storage location in this table holds the UPC number. The next two locations contain an alphanumeric brand name and the type of the liquor which are typed by the user on keyboard 82 and then stored. Various messages presented to the user on display 76 prompt the entry of these different items of data. The volume of the bottle then is entered into the keyboard and stored in the location of the liquor brand data table 122. Next, the user enters the volume of each serving of liquor to be poured from the bottle and the price per serving.

Another storage location in table 122 contains the pour time which is the period that the spout valve is opened. The pour time can be set empirically by measuring the time required to pour a serving of that particular liquor or the pour time can be approximated using a table of values for different types of liquor and liqueur. Thus, the time that the spout valve is opened to be set for each bottle in order to account for the particular viscosity of the liquor in the bottle.

Typically, when a bottle is empty, its spout 18 will be replaced onto a bottle of the same brand of liquor and the bartender does not have to reenter all of the liquor brand data. However, when the spout 18 is transferred from one bottle to another, the controller 26 must be placed into the bottle registration and the UPC number scanned so that the controller's microcomputer will be informed that the spout has been transferred to a new full bottle.

That completes the items of information which the user must enter about the brand of liquor in the particular bottle. In an installation having multiple beverage dispensing stations 10 as shown in FIG. 1, the information about the new liquor bottle is transferred to the personal computer 8. The personal computer then broadcasts that information over the local area network 7 so that all of the beverage dispensing stations 10 are able to recognize and dispense liquor from that particular bottle. Alternatively, the person inserting the spout onto the bottle can designate that only certain beverage dispensing stations 10 are to be able to dispense from that bottle. In which case, the personal computer 8 transfers the information about the bottle only to the designated stations on the local area network which are the only ones that will recognize that bottle, i.e. pour from a bottle having the associated spout identification code. Similarly, at any time the personal computer can send a command to one or more stations to disable dispensing from a particular bottle based on the identification code of its spout.

The table 122 of data associated with the particular brand of liquor also contains storage locations in which microcomputer 70 stores different items of data during the operation of the dispensing station 10. For example, these items of data include the number of pours of that particular liquor, the total volume of this brand that has been poured, and the sales value of that liquor which has been poured. Similar items of data are retained for complimentary drinks that have been served and beverage pours which were canceled by the operator, as will be described. One controller 26 may operate multiple interrogators 90 and actuators 22, in which case the data in table 122 for a particular liquor brand represents drinks dispensed at different stations of a bar and from several bottles of that liquor brand.

When a bartender mixes a drink, the appropriate bottle is selected and the actuator ring 22 is placed over the bottle's spout 18. Upon inverting the bottle 14 into the conventional pouring position shown in FIG. 3, the tilt switch 66 opens which is sensed by the microcomputer 70 as an indication that pouring of liquor is desired.

With reference to FIG. 5, microcomputer 70 responds to the tilt switch signal by sending a command to enable interrogator circuit 90. The interrogator interface 92 receives the command and activates the oscillator 94 which begins transmitting an RF signal via the interrogator coil 58. Because of the close proximity between the interrogator coil 58 in the actuator 22 and the transponder coil 54, the RF signal induces a voltage across the transponder coil 54 which activates the transponder 52 in the bottle spout 18. Upon that activation, the binary identification code is serially clocked out of the transponder circuit 100 and changes in the loading of the transponder coil 54. The changes in loading alter the current flowing through interrogator coil 58 thereby enabling controller 26 to recover the identification code from the transponder 52 as previously described.

Thereafter, the microcomputer 70 uses the identification code from the spout to access information stored in RAM 71 for the associated liquor bottle. Specifically, the identification code is used to look-up the UPC number in the stored bottle data table 120 (FIG. 8). The UPC number is used to access the associated entry in the liquor brand data table 122 (FIG. 9) in RAM 71 from which the brand and type of liquor in the bottle are read and displayed by the microcomputer 70 on display 76.

Then, the microcomputer 70 activates the valve driver 86 which energizes the valve operating coil 60. This action produces a strong magnetic field through the spout 18 which causes the ferromagnetic valve member 44 to move away from the valves seat 48 thereby opening the valve. The valve operating coil 60 is energized for the pour time interval that is read from the liquor brand data table 122. At the end of that interval the valve driver 86 is deactivated to close the valve in the bottle spout 18. If additional liquor is to be poured from the same bottle 14, the bartender tips the bottle upright and then inverts the bottle to dispense another measured quantity. When the bartender finishes pouring from the bottle 14, the actuator 22 is removed and the bottle returned to the shelf. The actuator then can be used to pour liquor from another bottle in the bar.

At the completion of each pour, the microcomputer 70 in controller 26 updates the information stored in tables of RAM 71. Specifically, the liquor brand table 122 is updated by incrementing the number of pours and the price per serving is added to the sales value. In addition, the volume of a serving is added to the volume of pours in table 122 and to the volume poured from that bottle in table 120.

If the bartender is dispensing a complimentary drink, a button is pressed on the keyboard 82 prior to the pour to indicate the nature of that transaction. The liquor is poured as described above, except the values for the complimentary pours, complimentary volume and complimentary sales are changed in the liquor brand table 122 instead of the corresponding values for normal drinks.

If a bartender begins pouring a drink from a wrong bottle, pouring is stopped and a cancel button is pressed on the keyboard 82. The time of the aborted pour is used to determine how much liquor was dispensed. For example, the actual pour time and the pour time for a full serving are used to compute the proportion of a full serving that was poured. That proportion and the volume of a serving is used to derive the volume of the aborted pour. The aborted volume is added to the canceled volume in the liquor brand data table 122. The proportion of the serving price also is derived and added to the canceled sales value in addition to incrementing the count of canceled pours.

When the bottle is empty and the spout is placed on a new bottle of the same brand, the total volume (a sum of volume of pours, complimentary volume and canceled volume) dispensed from the previous bottle is compared by the microcomputer 70 to the volume of the bottle when full. This comparison indicates whether unaccounted servings were dispensed.

The beverage dispensing station 10 also can control pouring a number of types of liquor to mix a cocktail. Most common cocktails are a mixture of five or less different liquors. To serve a cocktail, the bartender presses an appropriately labelled button on keyboard 82 and the display 76 prompts the bartender with the particular type of liquor to pour. The controller 26 governs the pouring and as each liquor is poured, the dispensed quantity and other parameters for the particular bottle of liquor are updated. A custom keypad with buttons labelled for different cocktails can be attached in place of the full alphanumeric keyboard 82.

In order to implement the cocktail feature, the microcomputer 70 must first be programmed with the recipe for the cocktail. To do so, the bartender or tavern manager places the controller 26 in the cocktail program mode by entering of a command into keyboard 82 or selecting a menu item on display 76. In the cocktail program mode, the appropriate button on keyboard 82 to be used in dispensing the cocktail is identified and data for the cocktail is stored along with that button identification within a table in RAM 71. The data structure of a cocktail data table 124 is depicted in FIG. 10. A first storage location contains an identification of the associated keyboard button and the second item of information is the name o the cocktail entered in alphanumeric characters.

Then, five ingredients are identified by specifying the liquor types used in the liquor brand data tables 122. For each liquor type ingredient, a volume is also specified in the units of measurements (ounces or milliliters) used by beverage dispensing system 6. If less than five ingredients are required for a particular cocktail, the remaining storage locations for ingredients are left blank, or null. The price for each cocktail is stored in another table location. Additional storage locations are provided in table 124 to count the number of cocktails served and tabulate the total sales value of those cocktails. Other locations are used to tabulate the number of pours and sales value for complimentary cocktails and for canceled cocktails.

Figure 11:
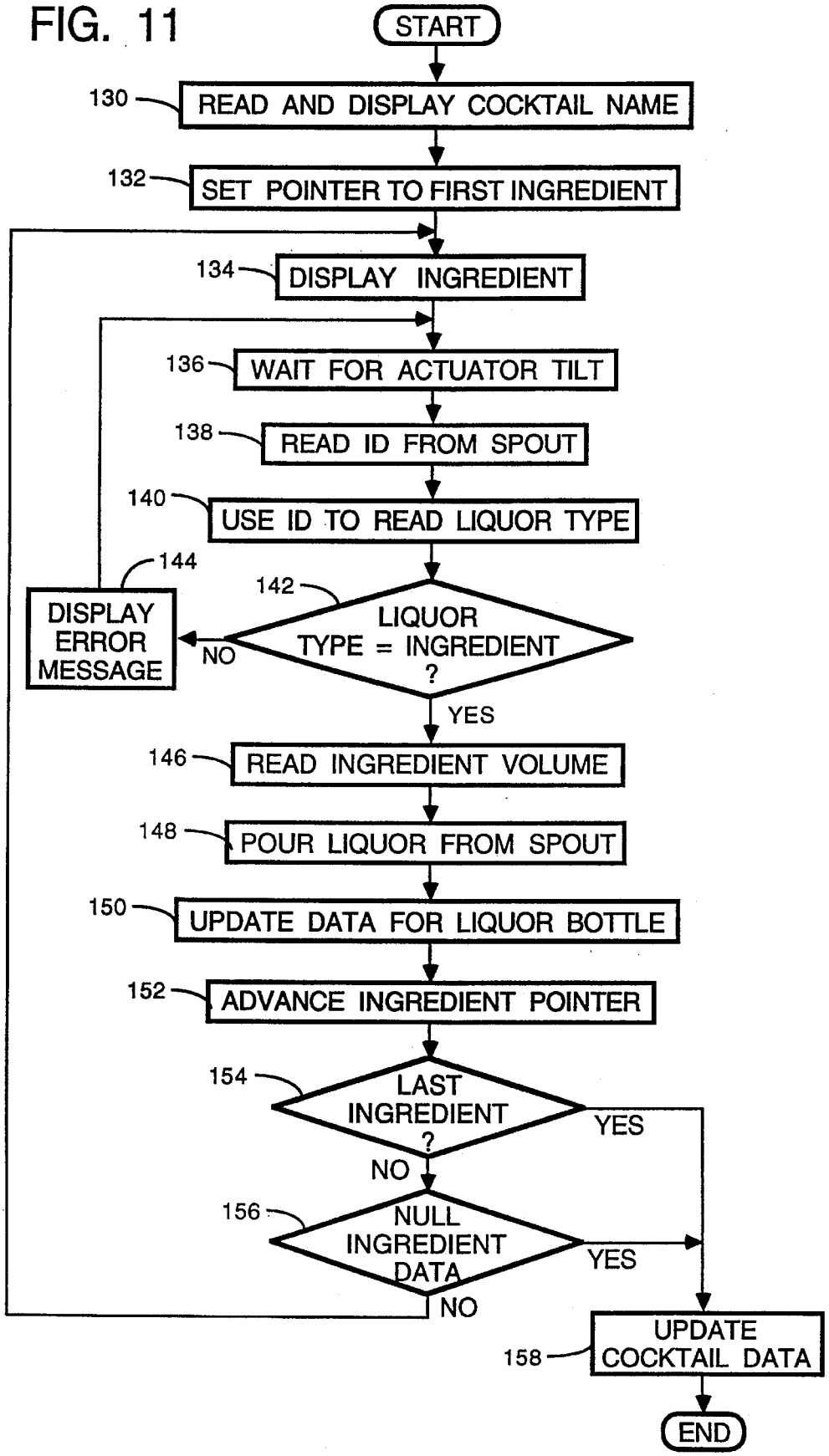
FIG. 11 is a flowchart of the process by which the beverage dispensing system is used to mix a cocktail.

When the bartender desires to dispense a particular cocktail, the corresponding button on keyboard 82 is pressed. The microcomputer 70 responds by executing a software routine depicted in the flowchart of FIG. 11. Initially at step 130, the microcomputer utilizes the identification of the particular keyboard button that was pressed to access the table within RAM 71 that contains the information about that cocktail. The microcomputer 70 reads the name of the cocktail and displays that information to the bartender via display 76. A pointer then is set at step 132 to the first ingredient within the cocktail data table 124 for the designated cocktail. The pointer is used to read and display the name of the first ingredient to the bartender at step 134. The microcomputer then waits at step 136 for the tilt switch 66 to open indicating that a bottle has been placed on the actuator 22 and the assembly inverted into the pour position. When that occurs, the program execution advances to step 138 where the interrogator circuit 90 is activated to read the identification code from the selected bottle's spout, in the manner previously described.

Then at step 140, that spout identification code is used by the microcomputer to access the bottle data information stored in table 120 within RAM 71 and in turn access the liquor brand data table 124 to read the type of liquor in the selected bottle. At step 142, the microcomputer 70 determines whether the liquor type in this bottle matches the first ingredient of the cocktail. If the bartender has selected an incorrect bottle, program execution branches to step 144 where an error message is presented to the user on display 76. The program execution then returns to step 136 where the microcomputer waits for another tilt indication from switch 66 in the actuator as will occur when the bartender has selected another bottle. Alternatively, if the liquor bottle does not match the desired cocktail ingredient, the microcomputer 70 can check the other ingredients for the cocktail and continue the pour process for the other ingredient. This alternative does not require that the ingredients be dispensed in the fixed order as listed in the cocktail data table 120.

When at step 142 a determination has been made the selected bottle contains the proper ingredient for the cocktail, the program execution advances to step 146 at which the microcomputer 70 reads the volume of the particular ingredient from the cocktail data table 124. This volume of that ingredient used in the cocktail may be different than the volume of a typical serving of that liquor as defined in the liquor brand data table 122 stored elsewhere in RAM 71. As a consequence, microcomputer 70 then determines the proportion that the cocktail ingredient volume is of the volume of a serving for that liquor brand. That proportion along with the pour time for the selected liquor brand is used to calculate the time that the spout valve should be maintained in an open state to dispense the proper amount of this type of liquor for the cocktail. Once the dispensing time has been determined, the program execution opens the spout for the determined interval in order to pour the desired quantity of liquor into the cocktail glass at step 148. The process by which the controller 26 opens the spout is identical to that previously described.

Following each liquor pour, the data regarding the number of pours and the volume poured in the liquor brand data table 124 are updated at step 150 with the quantity of liquor dispensed for the cocktail. The sales value for this particular bottle is not updated as the sales information is stored separately for this particular cocktail. Then at step 152, the ingredient pointer is advanced to the next ingredient within the cocktail data table. At step 154, a determination is made whether the ingredient pointer has been moved beyond the fifth ingredient, indicating that all of the ingredients for the cocktail already have been poured. If that is not the case, the program execution advances to step 156 where the name for the next ingredient indicated by the pointer is read and inspected to see if it is a null data field. If the ingredient is not null, indicating that yet another ingredient has been defined for this cocktail, the program execution returns to step 134 where the liquor type for this ingredient is presented to the bartender on display 76 so that this ingredient of the cocktail can be added to the mixing glass.

This process repeats until either the ingredient pointer is incremented beyond the fifth ingredient or a null ingredient field is found, at which time the program execution branches from step 154 or 156 to step 158. At this juncture, the number of cocktails served is incremented and the price per cocktail is added to the sales value of the cocktails dispensed. Although not shown in the flowchart of FIG. 10, if a pour is canceled or a complimentary cocktail is served as indicated by a bartender, the appropriate storage locations within the cocktail data table 124 depicted in FIG. 10 will be updated. Therefore, at any given time, the data stored in RAM 71 accurately represents the quantity and dollar value of liquor that has been dispensed from each bottle.

The network interface 88 in FIG. 5 allows the beverage dispenser controller 26 to be connected via local area network 7 in FIG. 1 to the personal computer 8 that can provide more sophisticated inventory control and management reports. For example, each dispensing station 10 in the tavern can transfer the data for all the liquor bottles 12 and 18 to the personal computer 8 either daily or at the end of each work shift during the day. The personal computer calculates the differences between the new data and data previously transferred to determine the quantity of liquor served and the revenue generated during intervening period. The quantity of liquor served can be used to determined when to order more bottles of a particular brand of liquor. In addition, the personal computer 8 can use the transferred data to produce reports on the productivity of each dispensing station 10 and its bartender. An indication also can be provided of which beverage dispensing stations have poured drinks from a particular bottle.

Periodically, the inventory data regarding the contents of each bottle at a bar can be visually verified to detect data errors and removal of a spout to pour liquor from a bottle. The verification commences by the tavern manager entering the proper command into the appropriate beverage dispensing station 10 via keyboard 82. A bottle is selected and the actuator 22 placed around the bottle spout 18. In this mode of operation, the controller 26 interrogates the spout to read the identification code from the spout transponder circuit 52 without having to invert the bottle. The controller 26 uses the identification code to obtain data stored in the bottle data table 120 regarding the volume of liquor poured from that bottle. This data and the volume of the full bottle from table 122 are used to compute the quantity that should be remaining in the bottle.

That remaining quantity is presented on display 76. The user can compare the displayed quantity to the level of liquor in the bottle and determine if the stored data accurately reflects the actual amount of liquor in the bottle. A discrepancy may indicate unauthorized dispensing of liquor by removing the spout from the bottle. This process can be repeated for all of the bottles at that bar.

A more accurate method of verifying the amount of liquor remaining involves weighing the bottle on scale 85 in FIG. 5. In this version, each record in the liquor brand data table 122 also stores the weight of a full bottle and the weight of an empty bottle. A full bottle of a particular size and brand of liquor is weighed and the weight transferred from the scale 85 to the microcomputer where the weight is stored as another entry in the appropriate record of the liquor brand data table 122. A similar process is used to store the weight of an empty bottle of that size and brand with a spout attached. The weights of a full and empty bottle enable the microcomputer 70 to calculate the weight of each ounce, or similar incremental quantity, of the liquor in the bottle. The per ounce weight also can be stored in table 122.

During the inventory verification process, an actuator 22 is used to read the identification code from a particular bottle's spout, as described immediately above. The microcomputer 70 uses the identification code to access the weight information for that bottle. The actuator is removed and the bottle is weighed on the scale 85. The weight of an empty bottle and spout are subtracted from the measured weight of this bottle to derive the weight of the liquor remaining in the bottle. Using the weight of remaining liquor and the weight of each ounce of that type of liquor, the number of ounces in the bottle are calculated. That calculated quantity is compared to the quantity of liquor that should be remaining as indicated by the data about the volume of liquor dispensed from the bottle previously stored in the controller memory. Any discrepancy in the two quantities of liquor remaining in the particular bottle activates an alert to the tavern manager.

Although specific embodiments o#the invention have been set forth with a relatively high degree of particularity, it is intended that the scope of the invention not be so limited. Instead, the proper scope of the invention may include alternatives which are now within the purview of one skilled in the art. Thus, the scope should be ascertained by a reading of the claims that follow.

We claim:

1. A liquid dispensing system comprising:

a spout with a portion for engaging a liquid container, and having a flow passage controlled by a magnetically operable valve and a transponder which transmits an identification code that is unique to the spout;

an interrogator for reading the identification code from the spout transponder;

an actuator which is separate and detachable from said spout and which produces a magnetic field which opens the valve; and a controller connected to said interrogator to receive the identification code read from the spout and connected to said actuator to control production of the magnetic field to open the valve for a predefined period of time, said controller including a memory having storage locations associated with the identification code in which the storage locations contain data regarding a volume dispensed from the liquid container and a number of volume units of liquid present in the liquid container when full, wherein the data regarding a volume dispensed from the liquid container is updated in response to the valve being opened, the controller including a mechanism for calculating a quantity of liquid remaining in the liquid container.

2. The liquid dispensing system as recited in claim 1 wherein said memory further includes a storage location which contains a price per volume unit; and the mechanism of said controller calculates a dollar value of liquid that has been dispensed from the liquid container.

3. The liquid dispensing system as recited in claim 1 wherein said memory has a storage location which contains a name of the liquid in the liquid container to which the spout is attached.

4. The liquid dispensing system as recited in claim 3 wherein said controller further comprises a device for displaying the name of the liquid to a user.

5. The liquid dispensing system as recited in claim 1 further comprising a bar code reader connected to said controller for reading a product code on the liquid container.

6. The liquid dispensing system as recited in claim 5 wherein said memory further includes a storage location for storing the product code and another storage location that stores an identification of a kind of liquid in the liquid container.

7. The liquid dispensing system as recited in claim 1 wherein said memory further includes a storage location that contains pour data which is used by said controller to determine an amount of time that the valve is to be held open to dispense liquid from a bottle to which said spout is attached.

8. The liquid dispensing system recited in claim 1 further comprising a scale connected to said controller to provide weight measurements; and wherein said memory also has storage locations, associated with the identification code, which contain data related to a weight of an empty bottle and at least one of a weight of a full bottle and a weight of a volume unit of liquid.

9. A dispensing system for a facility having a plurality of bottles from which liquid is dispensed, said dispensing system comprising:

a plurality of spouts, each spout having a portion for attachment to one of the plurality of bottles, and having a flow passage controlled by a magnetically operable valve and a radio frequency transponder which upon receiving an activation signal transmits an identification code that is unique among said plurality of spouts;

an actuator assembly which is placed adjacent to a given spout while pouring liquid from the bottle attached to the given spout, and having an interrogator coil and valve operating coil that produces a magnetic field which opens the valve in the given spout;

an interrogator coupled to the interrogator coil to send the activation signal to the transponder and read the identification code; and a controller having an input connected to the interrogator, a driver connected to the valve operating coil to open a valve in a selected spout response to said interrogator reading the identification code from the selected spout, and a memory with a group of storage locations for each of the plurality of spouts, a group of storage locations for a given spout containing the identification code for the given spout and data regarding a total volume dispensed from a particular bottle to which the given spout is attached, a quantity present in the particular bottle when full, and a price per volume unit, and wherein upon the driver opening the valve of the selected spout, data regarding a total volume in a group of storage locations which contain the identification code read from the selected spout is updated.

10. The dispensing system as recited in claim 9 wherein:

said memory stores a table containing data relating to a cocktail, the table containing a name of the cocktail, a name of a first ingredient and a quantity of the first ingredient to be dispensed for the cocktail, and a name of a second ingredient and a quantity of the second ingredient to be dispensed for the cocktail.

11. The dispensing system as recited in claim 10 wherein the table includes storage locations containing a numerical count of the cocktails served, a price for each cocktail, and a cumulative monetary value of cocktails served.

12. The dispensing system as recited in claim 10 wherein said controller further includes a device for displaying information to a bartender; and a mechanism by which a bartender indicates the desire to dispense a cocktail, and in response to activation of the mechanism the controller displays the name of the first ingredient and the name of a second ingredient on the device.

13. A method for dispensing liquid from a bottle having a spout with a magnetically operated valve and a transponder, said method comprising steps of:

placing an actuator in proximity to the spout;

interrogating the transponder to obtain an identification code that is unique to the spout;

energizing the actuator for a predetermined period of time to produce a magnetic field that causes the valve to open;

storing in a memory information which indicates a quantity of liquid that was dispensed from the bottle while the valve was opened; and calculating from the information a monetary value for the quantity of liquid that was dispensed from the bottle.

14. The method as recited in claim 13 further comprising in response to interrogating the transponder to obtain an identification code, reading from a memory a name for the liquid in a bottle associated with the identification code so obtained; and displaying the name to a user.

15. The method as recited in claim 13 further comprising in response to the identification code obtained by interrogating the transponder, reading from a memory data defining the predetermined period of time.

16. A beverage dispensing system comprising a plurality of dispensing stations connected by at least one communication link to a computer that monitors beverages dispensed at the dispensing stations from a plurality of liquid containers, wherein each dispensing station comprises:

a plurality of spouts, each spout having a portion for attachment to one of the plurality of bottles, a flow passage controlled by a magnetically operable valve and a transponder which upon receiving an activation signal transmits an identification code that is unique among said plurality of spouts;

an actuator assembly which is placed adjacent to a given spout while pouring liquid from the bottle attached to the given spout, and having an interrogator coil and valve operating coil that produces a magnetic field which opens the valve in the given spout;

an interrogator coupled to the interrogator coil to send the activation signal to the transponder in the given spout and read the identification code;

a controller having an input connected to said interrogator, a driver connected to the operating coil to open the valve of a selected spout in response to said interrogator reading the identification code from the selected spout, and a memory with a group of storage locations for each of the plurality of spouts, a group of storage locations for a given spout containing the identification code for a given spout and data regarding a total volume dispensed from a particular bottle to which the given spout is attached, a quantity present in the particular bottle when full, and a price per volume unit, wherein upon the driver opening the valve of the selected spout, data regarding a total volume in group of storage locations which contain the identification code read from the selected spout is updated; and an interface for communicating data, about liquid dispensed from each liquid container, over the communication link to the computer.

17. The beverage dispensing system as recited in claim 16 wherein said memory has a storage location which contains a name of the liquid in the liquid container to which the spout is attached.

18. The beverage dispensing system as recited in claim 17 wherein one of said dispensing stations further comprises device for inputting container data for each liquid container regarding the name of the liquid, the quantity present in the particular bottle when full, and a price per volume unit.

19. The beverage dispensing system as recited in claim 18 wherein said interface of the one of said dispensing stations transmits the container data to said computer; and wherein said computer transmits the container data for a plurality of liquid containers to a plurality of dispensing stations.

* * * * *